US006232275B1

(12) United States Patent
Ichihashi et al.

(10) Patent No.: US 6,232,275 B1
(45) Date of Patent: May 15, 2001

(54) LUBRICATING OIL COMPOSITION FOR AUTOMATIC TRANSMISSIONS

(75) Inventors: Toshihiko Ichihashi; Masayuki Kato, both of Chiba-ken; Takao Ishikawa, Kanagawa-ken; Yasuhiro Murakami, Kanagawa-ken; Kazuo Umesato, Kanagawa-ken; Rika Yauchihara, Kanagawa-ken, all of (JP)

(73) Assignees: Idemitsu Kosan Co., Ltd., Tokyo; Nissan Motor Co., Ltd., Yokohama, both of (JP)

( * ) Notice: Subject to any disclaimer, the term of this patent is extended or adjusted under 35 U.S.C. 154(b) by 0 days.

(21) Appl. No.: 09/448,436

(22) Filed: Nov. 24, 1999

(30) Foreign Application Priority Data

Nov. 26, 1998 (JP) ..... 10-335502

(51) Int. Cl.[7] ..... C10M 141/10

(52) U.S. Cl. ..... 508/192; 508/293; 508/294; 508/441; 508/442; 508/551; 508/554

(58) Field of Search ..... 508/192, 551, 508/554

(56) References Cited

U.S. PATENT DOCUMENTS 4,312,767 * 1/1982 Adams et al. ..... 508/159
4,634,543 * 1/1987 Okada et al. ..... 508/192
5,064,546 * 11/1991 Dasai ..... 508/436
5,110,488 * 5/1992 Tipton et al. ..... 508/192
5,330,667 * 7/1994 Tiffany, III et al. ..... 508/192
5,395,539 * 3/1995 Chandler et al. ..... 508/260
5,641,732 * 6/1997 Bloch et al. ..... 508/232
5,792,731 8/1998 Ichihashi et al. ..... 508/322
6,001,780 * 12/1999 Ho et al. ..... 508/192

* cited by examiner

*Primary Examiner*—Ellen M. McAvoy
(74) *Attorney, Agent, or Firm*—Oblon, Spivak, McClelland, Maier & Neustadt, P.C.

(57) ABSTRACT

There is disclosed a lubricating oil composition for automatic transmissions which comprises a base oil comprising at least one oil selected from the group consisting of a mineral oil and a synthetic oil each having a specific kinematic viscosity and a % $C_A$; (A) a non-boron based succinic acid imide (e.g. polybutenylsuccinic acid imide) and a boron based succinic acid imide each in an amount of 0.1 to 5% by weight based on the whole composition; (B) a condensation product of a branched chain fatty acid having 8 to 30 carbon atoms (e.g. isostearic acid) and an amine (e.g. tetraethylene-pentamine) in an amount of 0.05 to 2% by weight based on the same; and (C) a dialkyl hydrogenphosphite (e.g. dioleyl hydrogenphosphite) in an amount of 0.1 to 1% by weight based on the same, and optionally at least one member selected from viscosity index improvers, antioxidants, metal deactivators, defoaming agents, detergents, extreme pressure agents and rust preventives. The lubricating oil composition mentioned above is enhanced in the capacity of transmission torque, excellent in the performance of preventing shudder, and prolonged in the service lifetime of shudder prevention and capacity of transmission torque.

9 Claims, No Drawings

LUBRICATING OIL COMPOSITION FOR AUTOMATIC TRANSMISSIONS

BACKGROUND OF THE INVENTION

1. Field of the Invention

The present invention relates to a lubricating oil composition for automatic transmissions. More particularly, the present invention is concerned with a lubricating oil composition for automatic transmissions which is excellent in the performance of preventing shudder of friction materials in a clutch portion for automatic transmissions, enhanced in the capacity of transmission torque, and at the same time capable of maintaining the performance of preventing said shudder and the enhanced capacity of transmission torque for a long period of time.

2. Description of the Related Arts

There has been introduced in recent years, a slip control system of operating a lockup mechanism even in the region of low velocity of automobile transmissions in order to decrease a power transmission loss in automatic transmissions and improve fuel consumption. In the case, however, where a lockup mechanism is operated in the region of low velocity of automobile transmissions, there is frequently caused the problem that abnormal vibration of an automobile body called shudder takes place in lockup friction surfaces. In such circumstances, there is eagerly desired the development of a lubricating oil composition for automatic transmissions which is capable of preventing said shudder and maintaining the transmission torque at a high level for a long period of time.

It is known that in order to prevent the above-mentioned shudder, there is required such a $\mu$ (friction coefficient) —V (sliding velocity) characteristics that the friction coefficient increases with an increase in the sliding velocity. There has heretofore been suggested the use of a friction modifying agent such as a phosphoric acid ester and an amidocarboxylic acid. For instance, Japanese Patent Application Laid-Open Number 305082/1995 (Heisei-7) discloses a lubricating oil composition for automatic transmissions which comprises a base oil blended with ① a zinc dithiophosphate and/or a basic zinc dithiophosphate, ② at least one compound selected from the group consisting of phosphoric acid esters, acidic phosphoric acid esters and phosphorous acid esters and ③ an organic friction modifying agent in which a specific bond and/or a functional group are introduced in its molecules. The aforesaid composition, although being favorable in the initial performance of preventing shudder, suffers from the disadvantage that in the case of long-term usage, the zinc dithiophosphate is stuck to the surface of a wet clutch and markedly shorten the duration of preventing the shudder, thus making it impossible to maintain the initial performance. In addition, Japanese Patent Application Laid-Open Number 254196/1988 (Showa-63) discloses the use of a friction modifying agent such as a phosphoric acid ester, a fatty acid ester or a fatty acid amide as an additive for a lubricating oil composition for automatic transmissions. The above-mentioned composition, however, is insufficient in the initial performance of preventing the shudder.

That is to say, the use of the above-disclosed compound brings about such problems as insufficiency in the performance of preventing shudder, lowering of the friction coefficient ($\mu$) in a wet clutch portion and/or the shortage of capacity of transmission torque. Further, the problems still remain unsolved in that persistency of favorable $\mu$ -V characteristics is insufficient as compared with the service lifetime of automobile bodies, and frequent renewal of lubricating oil is forced to carry out.

SUMMARY OF THE INVENTION

Under such circumstances, a general object of the present invention is to reconcile both the performance of preventing shudder vibration and the capacity of transmission torque, and thereby provide a lubricating oil composition for automatic transmissions which has a long service lifetime.

Other objects of the present invention will be obvious from the text of this specification hereinafter disclosed.

In view of the foregoing, intensive extensive research and investigation were accumulated by the present inventors in order to achieve the objects. As a result, it has been found that the objects can be effectively attained by a method in which a specific base oil is blended with non-boron based and boron based succinic acid imides, a condensation product of a branched chain fatty acid and an amine, and a dialkyl hydrogenphosphite. The present invention has been accomplished by the foregoing findings and information.

Specifically, the present invention provides a lubricating oil composition for automatic transmissions which comprises a base oil comprising at least one oil selected from the group consisting of a mineral oil and a synthetic oil each having a kinematic viscosity at 100° C. of 1 to 30 $mm^2$/sec and a % $C_A$ (aromatic carbon content in percentage when measured by an n-d-M ring analysis method) of at most 20; (A) a non-boron based succinic acid imide and a boron based succinic acid imide each in an amount of 0.1 to 5% by weight based on the whole composition; (B) a condensation product of a branched chain fatty acid having 8 to 30 carbon atoms and an amine in an amount of 0.05 to 2% by weight based on the whole composition ; and (C) a dialkyl hydrogenphosphite in an amount of 0.1 to 1% by weight based on the whole composition.

DESCRIPTION OF THE PREFERRED EMBODIMENTS

The lubricating oil composition for automatic transmissions comprises a base oil, (A) a non-boron based succinic acid imide and a boron based succinic acid imide, (B) a condensation product of a branched chain fatty acid and an amine, and (C) a dialkyl hydrogenphosphite.

It is possible to employ any of a mineral oil and a synthetic oil as the base oil for the lubricating oil composition according to the present invention. There are usable, as the mineral oil, a variety of well known conventional mineral oils that are exemplified by paraffin base mineral oil, intermediate base mineral oil and naphthene base mineral oil. Specific examples thereof include a light neutral oil produced by solvent refining or hydrorefining, an intermediate neutral oil, a heavy neutral oil and bright stock.

There are usable, as the synthetic oil, a variety of well known conventional synthetic oils that are exemplified by polyα-olefin (including α-olefin copolymer), polybutene, polyol esters, dibasic esters, phosphoric acid esters, polyphenyl ethers, alkylbenzenes, alkylnaphthalenes, polyoxyalkylene glycols, neopentyl glycol, silicone oil, trimethylol propane, pentaerythritol and hindered esters. Any of the above-exemplified oils may be used alone or in combination with at least one other oil, for instance, the combination of a mineral oil and a synthetic oil.

It is necessary for the above-mentioned base oil to have a kinematic viscosity at 100° C. of 1 to 30 $mm^2$/sec and a % $C_A$ of at most 20. A a kinematic viscosity at 100° C. thereof, when being less than 1 $mm^2$/sec, leads to an increased friction at the sliding portions of a gear bearing and a clutch in the automatic transmission, whereas said kinematic viscosity, when being more than 30 $mm^2$/sec, brings about such inexpedience as the deterioration of low temperature characteristics of the oil. In view of the foregoing, the above-mentioned kinematic viscosity at 100° C. is preferably 2 to 20 $mm^2$/sec, more preferably 3 to 10 $mm^2$/sec. Moreover, the % $C_A$ thereof is preferably at most 10, since the % $C_A$ of more than 20 results in the deterioration of low temperature characteristics of the oil.

In the composition according to the present invention, there are used a general succinic acid imide ( non-boron based succinic acid imide ) and a boron-containing succinic acid imide (boron based succinic acid imide) in combination as the component (A) for the main purpose of improving dispersibility of sludge to be formed.

As the non-boron based succinic acid imide in particular, there is preferably used the succinic acid imide represented by the general formula:

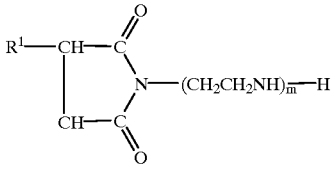

wherein $R^1$ is an alkyl group or an alkenyl group having 5 to 250 carbon atoms, and m is an integer from 0 to 6. $R^1$ is preferably a polybutenyl group or a polisoybutenyl group in particular. The aforesaid polybutenylsuccinic acid imide is usually synthesized by the reaction between polybutenylsuccinic acid anhydride and a polyamine, said acid anhydride being obtained by the reaction between polybutene and maleic acid anhydride, and said polyamine being exemplified by diethylenetriamine, triethylenetetramine, tetraethylenepentamine and pentaethylenehexamine.

On the other hand, a variety of boron based succinic acid imides are usable, and are exemplified by the above-mentioned succinic acid imides that are each treated with a boron compound (for instance, boric acid, boric acid anhydride, halogenated borons, boric acid esters, boric acid amides and boron oxide).

The above-mentioned non-boron based succinic acid imide and boron based succinic acid imide are each contained in the composition according to the present invention in an amount of 0.1 to 5% by weight. A content thereof, when being less than 0.1% by weight, will bring about insufficient dispersibility of sludge and lowering of transmission capacity, whereas a content thereof, when being more than 5% by weight, gives rise to a tendency to deteriorate the abrasion resistance of the composition and cause shudder and/or shock due to speed change. In view of the foregoing, said content is preferably 2 to 4% by weight.

The component (B) according to the present invention is a condensation product of a branched chain fatty acid having 8 to 30 carbon atoms and an amine. Said condensation product can be produced by the usual condensation reaction between said fatty acid and amine. The condensation reaction conditions at the time of producing the same are not specifically limited, but may be properly selected from a variety of conditions. The fatty acid may be either saturated or unsaturated, provided that it is a branched chain fatty acid, and is exemplified in particular by isolauric acid, isomyristic acid, isostearic acid and isoarachic acid. The amine may be any of the amines that are usually in use without specific limitation, and are preferably exemplified particularly by polyethylene polyamines derived from diethylenetriamine, triethylenetetramine and tetraethylenepentamine.

The amount of the above-mentioned condensation product as the component (B) to be used in the composition should be 0.05 to 2% by weight based on the whole composition. An amount thereof, when being less than 0.05% by weight, leads to insufficient effect upon improvement in $\mu$—V characteristics, whereas the amount thereof, when being more than 2% by weight, gives rise to insufficient capacity of transmission torque. In view of the foregoing, said amount is preferably 0.2 to 1% by weight.

The component (C) according to the present invention is dialkyl hydrogenphosphite. The alkyl group in this dialkyl hydrogenphosphite is not specifically limited. Preferably it has 4 to 30 carbon atoms, and may be an alkyl group having an unsaturated bond (alkenyl group to be exact). In particular, there are preferably usable dioleyl hydrogenphosphite and dilauryl hydrogenphosphite.

The amount of the foregoing dialkyl hydrogenphosphite as the component (C) to be used in the composition should be 0.1 to 1% , preferably 0.2 to 0.6% by weight based on the whole composition. An amount thereof, when being less than 0.1% by weight, causes insufficient properties of preventing friction of the surface of a clutch plate, thus resulting in shortened lifetime of preventing shudder, whereas the amount thereof, when being more than 1% by weight, gives rise to decreased friction coefficient and insufficient capacity of transmission torque.

Preferably, the composition for automatic transmissions according to the present invention is incorporated further with a viscosity index improver. Examples of preferably usable viscosity index improvers include olefin (co)polymer such as ethylene/propylene copolymer, polymethacrylate and polyisobutylene, of which is particularly preferably used polymethacrylate from the aspect of low temperature characteristics. Preferably, the molecular weight of the aforesaid viscosity index improver is in the range of 10,000 to 1,000,000, further 10,000 to 100,000, still further 10,000 to 50,000.

The above-mentioned viscosity index improvers are each blended in the composition according to the present invention in an amount of preferably 3 to 20% by weight. By the use thereof in an amount within said range, more preferable results are obtained with respect to low temperature startup performance and high temperature lubricating performance.

The lubricating oil composition for automatic transmissions according to the present invention, which is obtained by blending the base oil with the components (A), (B) and (C) as mentioned before, can be incorporated optionally at need with any of the aforesaid viscosity index improvers, phenol based or amine based antioxidants, thiadiazole based or benzotriazole based metal deactivators, alkyldimethylsiloxane based defoaming agents, detergents, extreme pressure agents and rust preventives.

The lubricating oil composition for automatic transmissions according to the present invention is enhanced in the capacity of transmission torque, excellent in the performance of preventing shudder, and prolonged in the service lifetime of both shudder prevention and capacity of transmission torque.

In the following, the present invention will be described in further detail with reference to comparative examples and working examples, which however shall never limit the present invention thereto.

TESTING METHODS FOR VARIOUS PERFORMANCES IN WORKING EXAMPLES AND COMPARATIVE EXAMPLES (1) Capacity of transmission torque According to the test in SAE No.2. According to Japan Automobile Standards Organization Method JASO M 348-95, by the use of the material D-0526-30 produced by Dinax Corp. as the disc, friction characteristics test was carried out at an oil temperature of 120° C., and an evaluation was made of the static friction coefficient ($\mu_s$) at 10,000 cycles.

(2) Lifetime of preventing shudder

According to LVFA test. According to Japan Automobile Standards Organization Method JASO M 349-98, by the use of the material D-0535 produced by Dinax Corp. as the disc, an evaluation was made of the period of time until the $\mu$ ratio ($\mu_1/\mu_{50}$) exceeds 1.0 under the conditions including an oil temperature of 40° C. and a surface pressure of 1.0±0.05 MPa, wherein $\mu_1$ is a friction coefficient at a sliding velocity of 0.006 m/s (1 rpm) and $\mu_{50}$ is a friction coefficient at a sliding velocity of 0.030 m/s (50 rpm).

EXAMPLE 1

The above-described performance tests were carried out by the use of a lubricating oil composition for automatic transmissions, which oil had been prepared by using, as the base oil, a paraffin base mineral oil having a kinematic viscosity at 100° C. of 4.3 $mm^2$/sec, and by blending therewith, 0.5% by weight of polybutenylsuccinic acid imide as the non-boron based succinic acid imide; 2.0% by weight of boron modified polybutenylsuccinic acid imide as the boron based succinic acid imide; 0.7% by weight of the condensation product of isostearic acid and tetraethylenepentamine as the condensation product of branched chain fatty acid and an amine; 0.3% by weight of dioleyl hydrogenphosphite as the dialkyl hydrogenphosphite; 10% by weight of polymethacrylate as the viscosity index improver; and 1.8% by weight of other additives (Table 1, Foot note * 6). The results are given in Table 1.

EXAMPLES 2,3 AND COMPARATIVE EXAMPLES 1 to 4

In the same manner as in Example 1, various performance tests were carried out by the use of lubricating oil compositions for automatic transmissions, which oil had been prepared in accordance with Example 1 and had blending proportions as shown therein. The results are given in Table 1.

It can be seen therefrom that Examples 1 to 3 demonstrate high static friction coefficient($\mu_s$), which consequently leads to high capacity of transmission torque, and also verify positive gradient {$\mu$ ratio ($\mu_1/\mu_{50}$) being not more than 1.0 over a long period of time} of $\mu$—V characteristics in LVFA test, which consequently leads to excellent performance of preventing shudder.

TABLE 1-1

| | Example | | |
|---|---|---|---|
| | 1 | 2 | 3 |
| Blending proportions (% by weight) | | | |
| Base Oil*1 | balance | balance | balance |
| Component (A) | | | |
| Non-boron based succinic acid imide*2 | 0.5 | 1.5 | 1.0 |

TABLE 1-1-continued

| | Example | | |
|---|---|---|---|
| | 1 | 2 | 3 |
| Boron based succinic acid imide*3 | 2.0 | 2.0 | 1.5 |
| Component (B) | | | |
| Condensation product of fatty acid and amine4 | 0.7 | 0.7 | 0.7 |
| Component (C) | | | |
| Dioleyl hydrogenphosphite | 0.3 | 0.3 | 0.1 |
| Polymethacrylate*5 | 10.0 | 10.0 | 10.0 |
| Other additives*6 | 1.8 | 1.8 | 1.8 |
| Capacity of transmission torque expressed in terms of static friction coefficient ($\mu$s) | 0.124 | 0.125 | 0.123 |
| Lifetime of preventing shudder (hr) | 300< | 300< | 240 |

TABLE 1-2

| | Comparative Example | | | |
|---|---|---|---|---|
| | 1 | 2 | 3 | 4 |
| Blending proportions (% by weight) | | | | |
| Base oil*1 | balance | balance | balance | balance |
| Component (A) | | | | |
| Non-boron based succinic acid imide*2 | — | — | 1.0 | 1.0 |
| Boron based succinic acid imide*3 | 2.0 | 0.5 | 2.0 | 2.0 |
| Component (B) | | | | |
| Condensation product of fatty acid and amine*4 | 0.7 | — | 0.7 | 0.7 |
| Component (C) | | | | |
| Dioleyl hydrogenphosphite | 0..3 | 0.3 | — | — |
| Glyceride | — | 0.7 | — | — |
| Triisopropyl phosphate | — | — | 0.3 | — |
| Zinc alkyldithiophosphate | — | — | — | 0.3 |
| Polymethacrylate*5 | 10.0 | 10.0 | 10.0 | 10.0 |
| Ca sulfonate*7 | — | 3.0 | — | — |
| Other additives*6 | 1.8 | 1.8 | 1.8 | 1.8 |
| Capacity of transmission torque expressed in terms of static friction coefficient ($\mu$s) | 0.110 | 0.124 | 0.115 | 0.135 |
| Lifetime of preventing shudder (hr) | 240 | 30 | 20 | 0 |

{Remarks}

*1Base oil: a paraffin base mineral oil having a kinematic viscosity at 100° C. of 4.3 $mm^2$/sec

*2Non-boron based succinic acid imide: polybutenylsuccinic acid imide having a molecular weight of 2200

*3Boron based succinic acid imide: reaction product of polybutenylsuccinic acid imide having a molecular weight of 4300 and a boron compound [ $B(OH)_3$]

*4Condensation product of branched chain fatty acid and an amine: condensation product of isostearic acid and tetraethylenepentamine

*5Polymethacrylate: molecular weight of 40,000

*6Other additives: defoaming agent; dimethylsiloxane, metal deactivator; thiadiazole compound

*7Ca sulfonate: TBN = 300 mgKOH/g

What is claimed is:

1. A lubricating oil composition for automatic transmissions which comprises a base oil comprising at least one oil selected from the group consisting of a mineral oil and a synthetic oil each having a kinematic viscosity at 100° C. of 1 to 30 $mm^2$/sec and a % $C_A$ of at most 20; (A) a non-boron based succinic acid imide and a boron based succinic acid imide each in an amount of 0.1 to 5% by weight based on the whole composition; (B) a condensation product of a branched chain fatty acid having 8 to 30 carbon atoms and an amine in an amount of 0.05 to 2% by weight based on the whole composition; and (C) a dialkyl hydrogenphosphite in an amount of 0.1 to 1% by weight based on the whole composition.

2. The lubricating oil composition for automatic transmissions according to claim 1, where the non-boron based succinic acid imide as the component (A) is represented by the general formula:

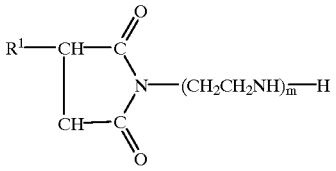

wherein $R^1$ is an alkyl group or an alkenyl group each having 5 to 250 carbon atoms, and m is an integer from 0 to 6.

3. The lubricating oil composition for automatic transmissions according to claim 1, wherein the fatty acid in the component (B) is at least one species selected from the group consisting of isolauric acid, isomyristic acid, isostearic acid and isoarachic acid.

4. The lubricating oil composition for automatic transmissions according to claim 1, wherein the amine in the component (B) is at least one species selected from the group consisting of diethylenetriamine, triethylenetetramine and tetraethylenepentamine.

5. The lubricating oil composition for automatic transmissions according to claim 1, wherein the dialkyl hydrogenphosphite as the component (C) is at least one species selected from the group consisting of dioleyl hydrogenphosphite and dilauryl hydrogenphosphite.

6. The lubricating oil composition for automatic transmissions according to claim 1, which further contains a viscosity index improver.

7. The lubricating oil composition for automatic transmissions according to claim 6, wherein said viscosity index improver is polymethacrylate.

8. The lubricating oil composition for automatic transmissions according to claim 1, which further contains at least one member selected from the group consisting of viscosity index improvers, antioxidants, metal deactivators, defoaming agents, detergents, extreme pressure agents and rust preventives.

9. The lubricating oil composition for automatic transmissions according to claim 1, wherein said base oil has a kinematic viscosity at 100° C. of 2 to 20 $mm^2$/sec and a % $C_A$ of at most 10.

* * * * *